US012484677B2

(12) United States Patent
Gilsoul et al.

(10) Patent No.: US 12,484,677 B2
(45) Date of Patent: Dec. 2, 2025

(54) INFRARED HAIRDRYER

(71) Applicant: BABYLISS FACO SPRL, Wandre (BE)

(72) Inventors: Frédéric Gilsoul, Hermalle-sous-Argenteau (BE); Liam Malone, Cambridgeshire (GB); Robinson Udale, Cumbria (GB)

(73) Assignee: BABYLISS FACO SRL, Wandre (BE)

( * ) Notice: Subject to any disclaimer, the term of this patent is extended or adjusted under 35 U.S.C. 154(b) by 873 days.

(21) Appl. No.: 17/773,551

(22) PCT Filed: Jul. 20, 2020

(86) PCT No.: PCT/EP2020/070419
§ 371 (c)(1),
(2) Date: Apr. 29, 2022

(87) PCT Pub. No.: WO2021/121678
PCT Pub. Date: Jun. 24, 2021

(65) Prior Publication Data

US 2022/0378165 A1 Dec. 1, 2022

(30) Foreign Application Priority Data

Dec. 20, 2019 (EP) ..... 19219027

(51) Int. Cl.
*A45D 20/12* (2006.01)

(52) U.S. Cl.
CPC ..... *A45D 20/12* (2013.01)

(58) Field of Classification Search
CPC ..... A45D 20/12
(Continued)

(56) References Cited

U.S. PATENT DOCUMENTS 4,635,382 A * 1/1987 Bourdeau ..... A45D 20/06 34/493
5,839,204 A * 11/1998 Cinque ..... A45D 20/10 D28/16

(Continued)

FOREIGN PATENT DOCUMENTS

EP 3838057 A1 * 6/2021 ..... A45D 20/10
FR 2428991 A1 1/1980

(Continued)

OTHER PUBLICATIONS

International Search Report and Written Opinion of the International Searching Authority from the European Receiving Office in PCT/EP2020/070419 on Sep. 30, 2020, which is an international application corresponding to this U.S. application.

*Primary Examiner* — Stephen M Gravini
(74) *Attorney, Agent, or Firm* — Kolitch Romano Dascenzo Gates LLC

(57) ABSTRACT

An infrared hairdryer of the present disclosure includes a housing with an air inlet and an air outlet. The housing includes a motorized fan, an infrared radiation source for emitting IR radiant heat, and a back reflector positioned between the fan and the infrared emitter. A filter is positioned at the outlet of the hairdryer, allowing IR wavelengths comprised between 1.2 μm and 15 μm, preferably between 2 and 8 μm to leave the hairdryer and stopping the IR wavelengths out of this range. The infrared source has a thermal inertia allowing the infrared source to reach a temperature up to 1000° C. in less than 10 seconds, preferably in less than 5 seconds.

20 Claims, 7 Drawing Sheets

(58) Field of Classification Search
USPC ..... 34/95–100
See application file for complete search history.

(56) References Cited

U.S. PATENT DOCUMENTS

| | | | | |
|---|---|---|---|---|
| 5,857,262 | A * | 1/1999 | Bonnema | F24H 3/0488 431/344 |
| 7,260,900 | B2 * | 8/2007 | Anthes | A45D 20/06 431/153 |
| 9,756,922 | B1 * | 9/2017 | Duthe | A45D 20/12 |
| 10,687,597 | B2 * | 6/2020 | Goldman | F26B 21/10 |
| 11,388,973 | B2 * | 7/2022 | Lei | A45D 20/12 |
| 11,510,472 | B2 * | 11/2022 | Julemont | A45D 20/50 |
| 11,641,918 | B2 * | 5/2023 | Jeong | A45D 20/12 34/97 |
| 11,832,698 | B2 * | 12/2023 | Wang | H05B 3/0033 |
| 12,137,785 | B2 * | 11/2024 | Sung | A45D 20/12 |
| 12,193,551 | B1 * | 1/2025 | Castaneda | A45D 20/12 |
| 2022/0378165 | A1 * | 12/2022 | Gilsoul | A45D 20/10 |

FOREIGN PATENT DOCUMENTS

| | | | | |
|---|---|---|---|---|
| WO | 2012039538 | A1 | 3/2012 | |
| WO | 2019155763 | A1 | 8/2019 | |
| WO | WO-2021121678 | A1 * | 6/2021 | A45D 20/10 |

* cited by examiner

INFRARED HAIRDRYER

FIELD

The present disclosure is related to an infrared hairdryer.

INTRODUCTION

Hairdryers using infrared (IR) radiation have been used in the past but they were not quite successful in the market for various reasons. This type of hairdryers was equipped with large bulky infrared lamps, making the handling of those devices difficult. In addition, infrared hairdryers of the prior art produce often excessive temperatures, i.e. up to 230 degrees, damaging the hair structure.

Document FR2428991 tried in 1976 to avoid the drawbacks of those IR lamp hairdryers by proposing a less bulky IR hairdryer emitting specific wavelengths in lower temperature ranges. This document discloses a hairdryer that includes a fan to blow an air stream at low velocity out of the dryer, an IR energy source to emit infrared radiation, an anodized parabolic reflector which modifies the radiated energy by only reflecting selected wavelengths, and a transparent IR filter to further narrow the emitted IR radiation to the desired wavelength range. The hairdryer of this document uses a selected range of wavelengths of infrared radiation in order to produce low temperatures, around 90° C., when the hairdryer is placed at a distance of 25 cm. The preferred wavelength ranges disclosed in this document are about 2 to 3 and 6 to 8 μm, because water absorbs the main energy at this wavelength. The maximum IR absorption spectrum of wet hair and the most efficient drying occur when these wavelengths are emitted from the dryer. An advantage of this disclosure is that as the hair is being dried, the dry hair protects the scalp since it does not absorb the selected IR wavelengths.

Nevertheless, the disadvantage of this device is that the heating time of the emitter is high, up to 80 seconds, and the user has to wait before using the hairdryer at its optimum temperature.

SUMMARY

The present disclosure aims to provide an infrared hairdryer using a narrow range of wavelengths of infrared (IR) radiation, with an infrared emitter having low thermal inertia, to be able to reach its working temperature in a few seconds leading to a precise temperature regulation for an optimal drying.

Another aim of the present disclosure is to provide an infrared hairdryer with an improved air stream adapted to the particular configuration of an infrared hairdryer.

The present disclosure is related to an infrared hairdryer, using in particular a selected range of wavelengths of infrared (IR) radiation, and having an improved IR emitter with low inertia.

The present disclosure teaches an infrared hairdryer comprising:

- a housing with an air inlet and an air outlet, the housing including a motorized fan;
- an infrared radiation source for emitting IR radiant heat;
- a back reflector positioned between the fan and the infrared emitter;

a filter positioned at the outlet of the hairdryer allowing IR wavelengths comprised between 1.2 μm and 15 μm, preferably between 2 and 8 μm to leave said hairdryer and stopping the IR wavelengths out of this range;

wherein the infrared source has a thermal inertia allowing the infrared source to reach a temperature up to 1000° C. in less than 10 seconds, preferably in less than 5 seconds.

According to preferred embodiments, the infrared hairdryer is further limited by one of the following features or by a suitable combination thereof:

- the infrared radiation source is in the form of a mesh or an etched foil;
- the etched foil has a thickness comprised between 30 and 150 μm, preferably between 50 and 120 μm, most preferably around 100 μm;
- the mesh or the etched foil is arranged in a disc-shaped surface;
- the etched foil is made of FeCrAl alloy;
- the etched foil is maintained in the hairdryer by a holder made of mica allowing an electrical insulation;
- the infrared radiation source has a power density comprised between 5 and 15 $W/m^3$, preferably of 10 $W/m^3$;
- the filter is a silicon window filter;
- the back reflector is an anodized parabolic reflector made of aluminum;
- a side reflector is provided to reflect the peripheral radiation emitted by the emitter, said side reflector being in the shape of a ring;
- the infrared hairdryer comprises a deflector to deviate the air stream in a peripheral stream along the walls of the housing;
- the infrared hairdryer additionally comprises an air stream separator having a central channel to separate the air stream into two substreams, a central substream and a peripheral substream;
- the infrared hairdryer comprises an outlet grid at the air outlet to prevent the user to be in contact with the filter;
- the motorized fan of the infrared hairdryer is a radial fan.

REFERENCE SYMBOLS

Figure 1:
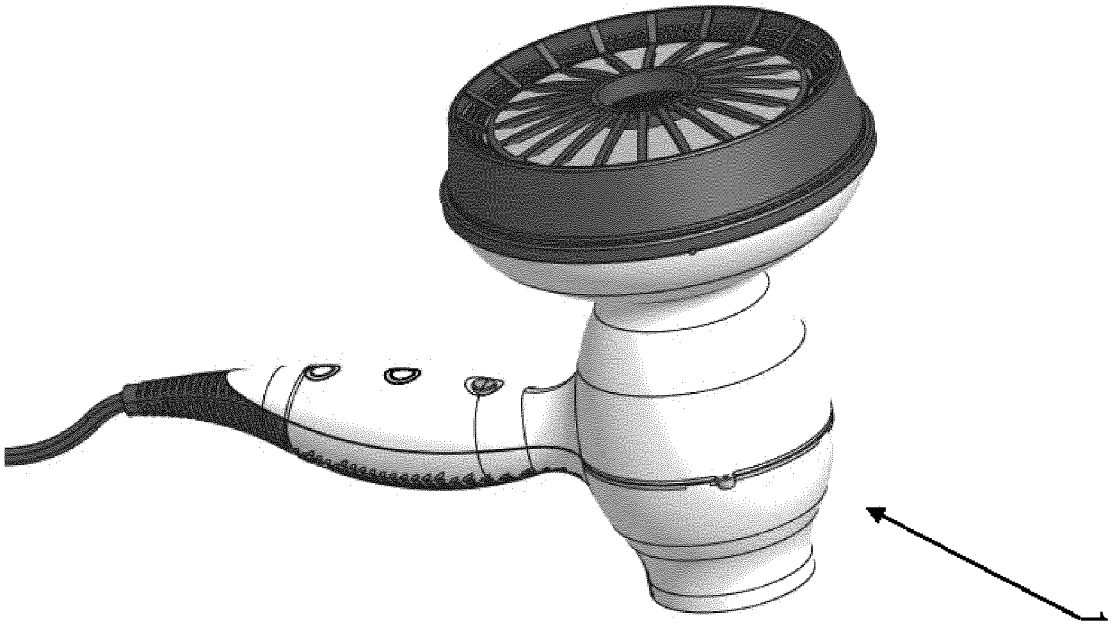
FIG. 1 is a perspective view of one embodiment of a hairdryer according to the present disclosure.
Figure 2:
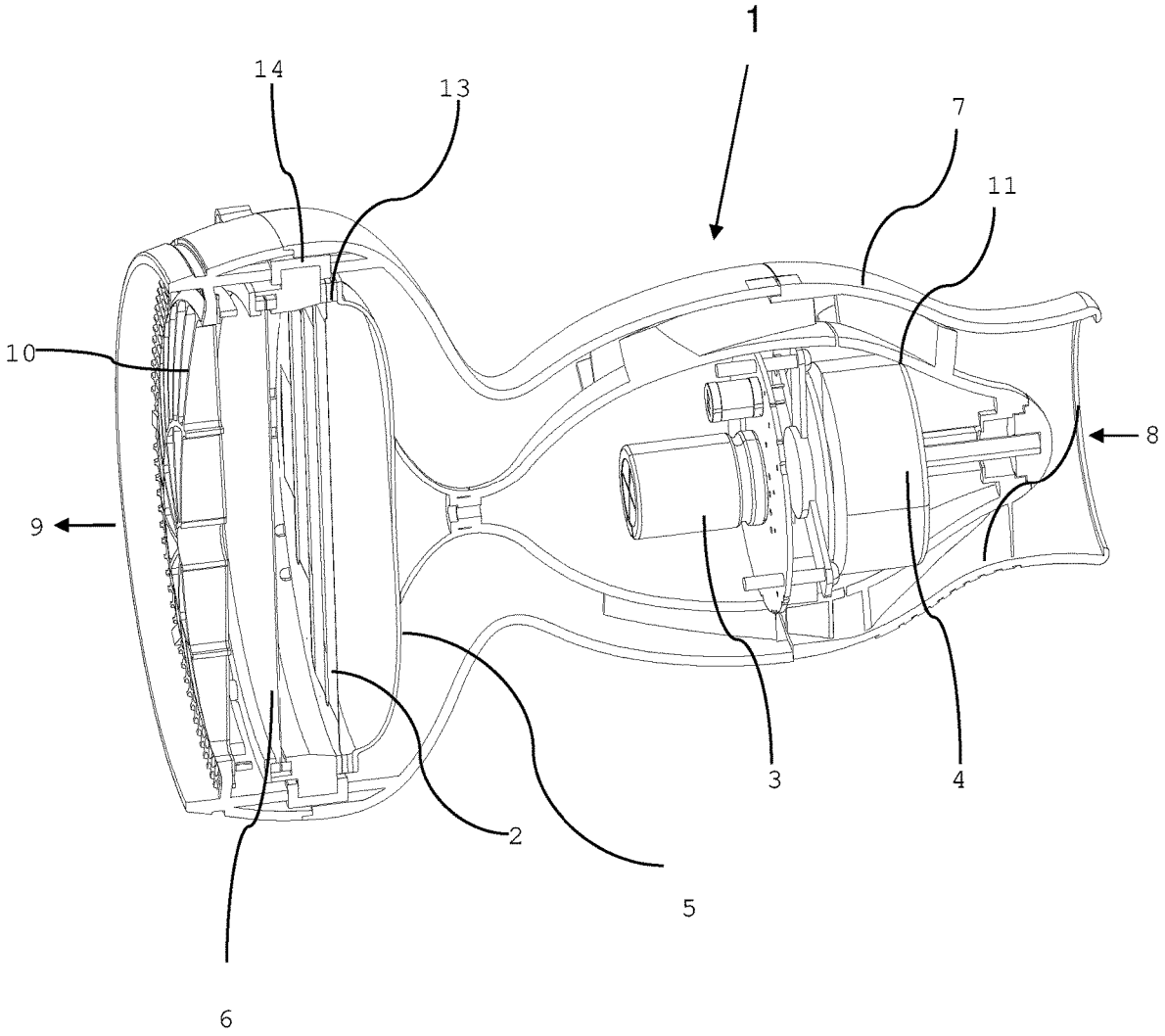
FIG. 2 represents a first detailed cross-sectional view of the hairdryer of the present disclosure, wherein the air stream provided by the fan is deviated by a deflector in a peripheral stream, licking the walls of the housing of the hairdryer.
Figure 3:
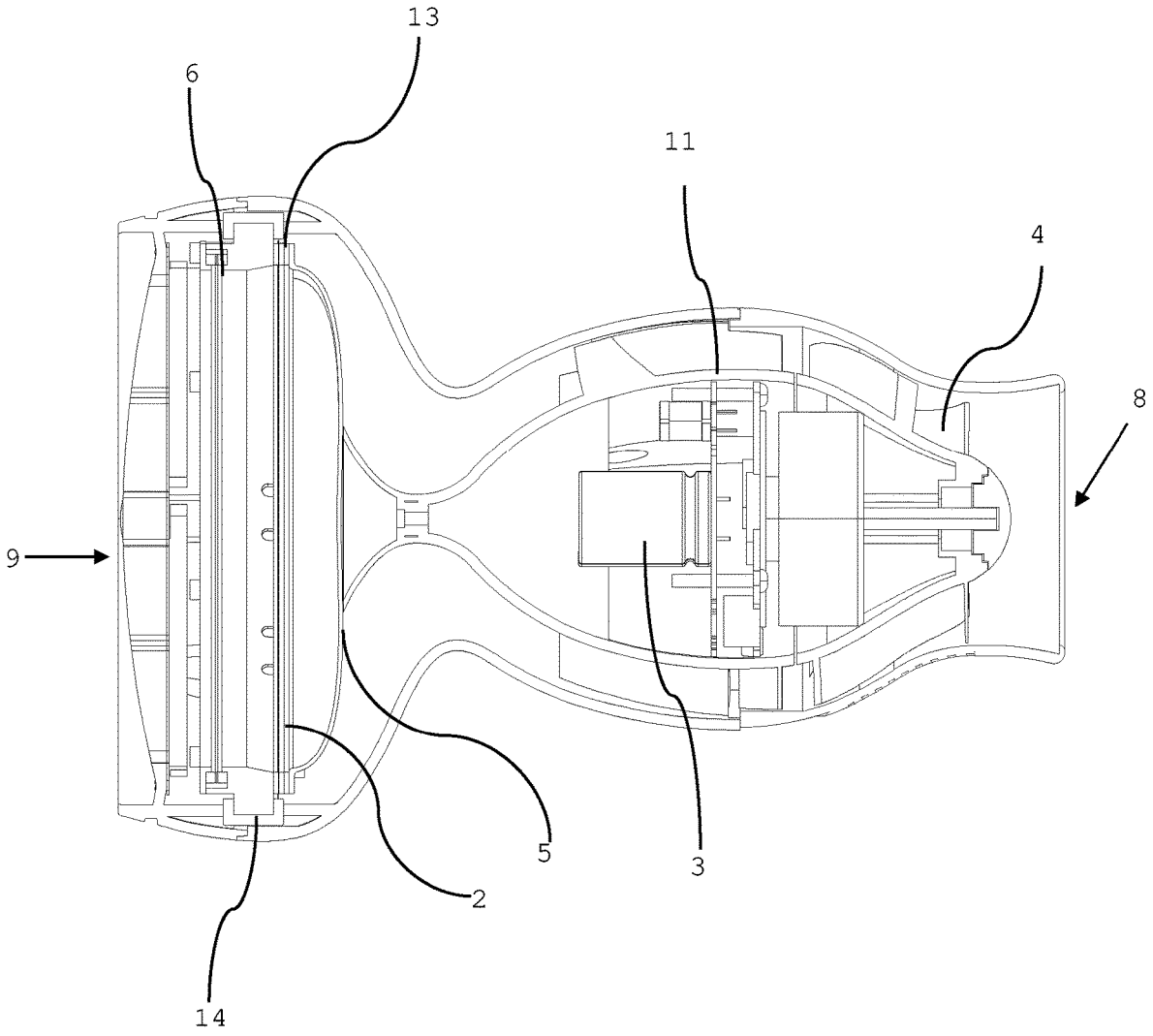
FIG. 3 represents a second detailed cross-sectional view of the hairdryer of the present disclosure.
Figure 4:
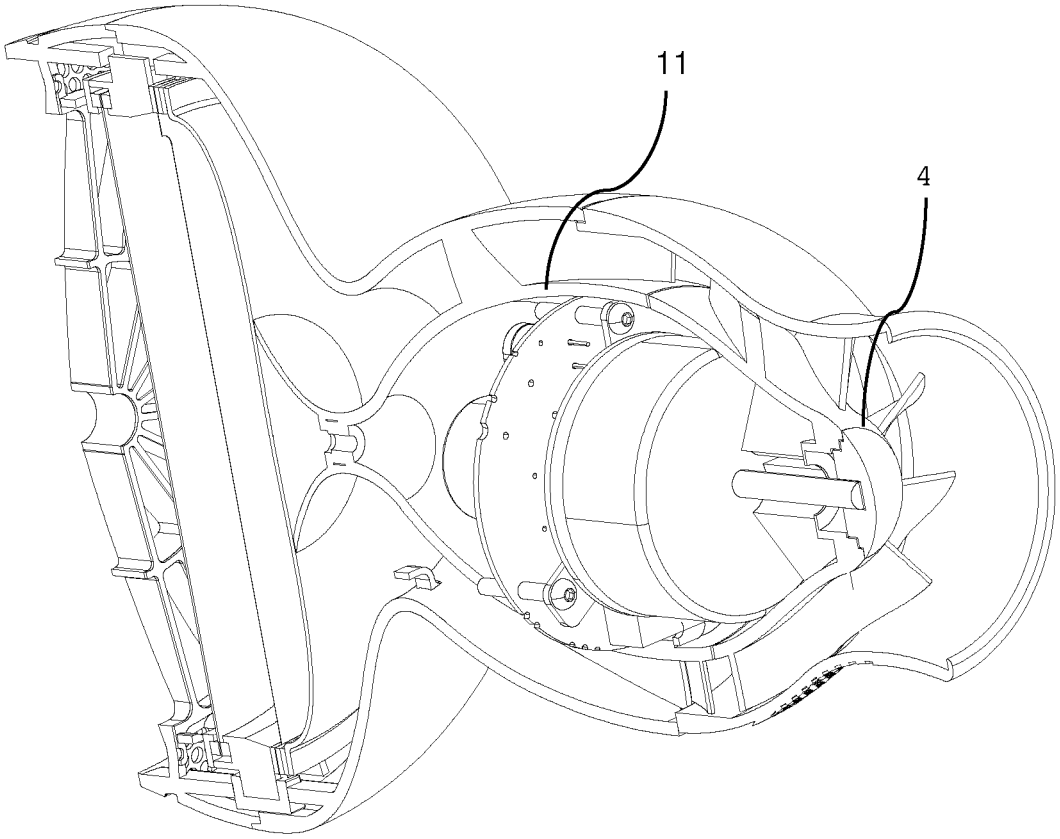
FIG. 4 represents a third detailed cross-sectional view of the hairdryer of the present disclosure.
Figure 5:
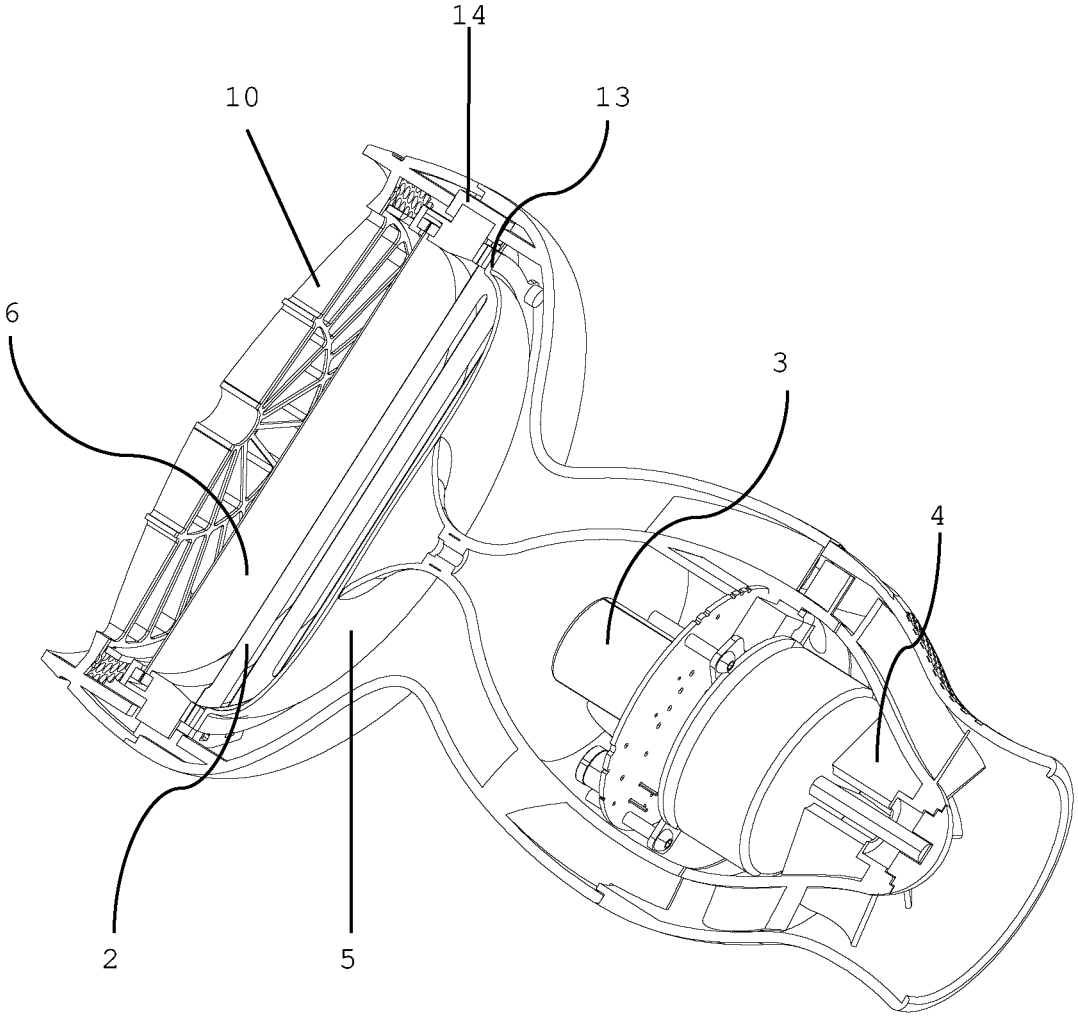
FIG. 5 represents a fourth detailed cross-sectional view of the hairdryer of the present disclosure.

1 Hairdryer
2 IR emitter (IR source)
3 Fan motor
4 Fan
5 Back reflector
6 Filter (silicon window)
7 Housing

8 Air inlet
9 Air outlet
10 Outlet grid
11 Deflector
12 Central channel
13 Mica holder (IR emitter support)
14 Side reflector
15 Air stream separator

DETAILED DESCRIPTION

The present disclosure relates to an infrared hairdryer 1 as illustrated by FIGS. 1 to 5 and 7, 8.

The infrared hairdryer comprises a housing 7 with an air inlet 8 and an air outlet 9. The housing includes a motor 3, which operates a fan 4 that blows an air stream out of the dryer by the air outlet 9. An infrared source 2 is located between the fan 4 and the air outlet 9 for emitting IR radiant heat. To be operational, the infrared hairdryer comprises a back reflector 5 provided between the fan 4 and the infrared source 2 and a filter 6 located at the outlet 9 of the hairdryer, as explained in more details below, in order to obtain emitted IR wavelengths of about 1.2 to about 15 μm, preferably of about 2 to 8 μm. The air stream provided by the fan is deflected by a deflector 11 in order to avoid the cooling of the IR emitter and maintain it at operational temperatures while removing the excess of heat from the body of the hairdryer.

The infrared source 2 has a low thermal inertia which allows to reach a temperature of up to 1000° C. in less than 10 seconds, preferably less than 6 seconds, 5 seconds or 4 seconds and most preferably, less than 3 seconds. The "thermal inertia" of a material represents its resistance to temperature change when a disturbance of its thermal equilibrium occurs. If the disturbance brings the material to a new equilibrium temperature, the thermal inertia is the time needed for this new equilibrium point to be reached. The infrared emitter has a power density comprised between 5 and 15 $W/m^3$, preferably between 8 and 12 $W/m^3$, for example 10 $W/m^3$. The low thermal inertia of the infrared emitter allows the IR dryer to be operable in a few seconds.

The Stefan-Boltzmann law describes the relation between the power radiated from a black body and its temperature, and states that the total energy radiated per unit surface area of a black body across all wavelengths per unit time j* (also known as the black-body radiant emittance) is directly proportional to the fourth power of the black body's thermodynamic temperature T:

$$J^*=\sigma\cdot S\cdot T^4$$

(σ is the constant of Stefan-Boltzmann=$5.670373\times10^{-8}$ $W\ m^2\ K^{-4}$ and S=emissivity compared to the black body).

Therefore, the total energy depends on the surface area (first power), and on the temperature (fourth power) of the IR source. To obtain a maximal total power output, the area of the emitter has to be maximized.

Figure 6:
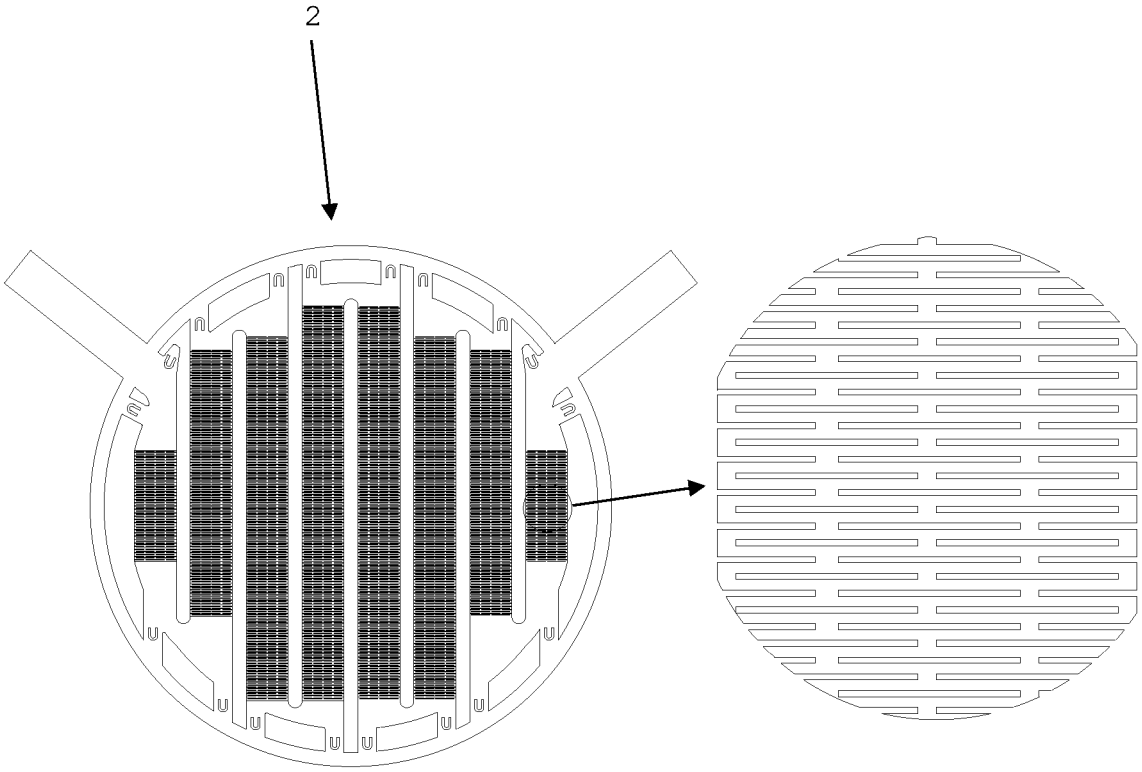
FIG. 6 represents a detailed view of an etched emitter of the hairdryer according to the present disclosure.

The infrared emitter 2 can be a mesh or an etched foil arranged in a disc-shaped surface, as illustrated by FIG. 6. The aim is to maximize the emission area within the disc surface. The surface area of the disc is greater than 30 $cm^2$, preferably greater than 50 $cm^2$.

A mesh has the property to offer, for the same heating surface, a smaller mass than a wire. The heating of the mesh is therefore faster.

A preferred alternative to the mesh is the etched foil, as illustrated in FIG. 6. A pattern is etched out of a metal foil, preferably made of a FeCrAl alloy and having a thickness comprised between 30 and 150 μm, preferably between 40 and 150 μm, for example of 100 μm. The etching technology allows the creation of a specific geometry leading to focused positions where the heating occurs in the foil. Indeed, the resistance increases in thinner parts of the etched foil, leading to increase the heating of these parts of the foil. It is possible to decrease the thermal inertia of the foil by creating an optimal design while avoiding the overheating of brittle parts of the foil. As illustrated in FIG. 6, the elements located in edges or turns are fuller than other parts of the foil. There is no resistive pattern at corners or on the legs of the foil and therefore no heating in unwanted areas. The etched foil is maintained in the hairdryer by a holder 13 made of a high temperature resistant material, for instance mica allowing an electrical isolation.

A back reflector 5 is provided between the fan 4 and the infrared emitter 2 to maximize IR radiation of the desired wavelength in the front direction and minimize radiation of the visible spectrum. This reflector is preferably an anodized parabolic reflector made of aluminum, having on its reflecting surface a darkly pigmented, anodized coating. In use, the infrared emitter 2 heats up and emits IR radiation. The wavelength of the IR radiation from the emitter 2 which is reflected by the parabolic reflector 5 is essentially in the range of about 0.8 μm and above, essentially all the remaining visible and IR radiation is absorbed. A side reflector 14 is also provided to reflect the peripheral radiation emitted by the emitter. The side reflector can have the shape of a ring, and is preferably made of aluminum.

The hairdryer comprises also a filter 6 to further narrow the wavelength and remove less preferred radiations. The filter is preferably a silicon window filter, located at the air outlet 9. The filter preferably filters out most of the IR radiation coming from the dryer except IR wavelengths greater than about 1.2 μm. The filter can be chosen to only allow IR wavelengths of about 1.2 to about 15 μm or preferably IR wavelengths of about 2 to 8 μm to be emitted, depending on the particular filter used. In order to obtain these results, the silicon resistivity must be between 0.25 pΩcm and 25 pΩcm.

In a preferred embodiment of the present disclosure, the hairdryer comprises a deflector 11 located in the housing to direct the flow. As illustrated by FIGS. 2 to 5, the deflector 11 has an elliptical shape to deviate the air stream provided by the fan in a peripheral stream, licking the walls of the housing. The air stream is blown out the hairdryer by the periphery without crossing the emitter, to maintain it at operational temperatures. The aluminum parts of the hairdryer are cooled to avoid overheating as the air stream provided by the fan is deflected by the deflector 11 to lick the walls of the housing.

Figure 7:
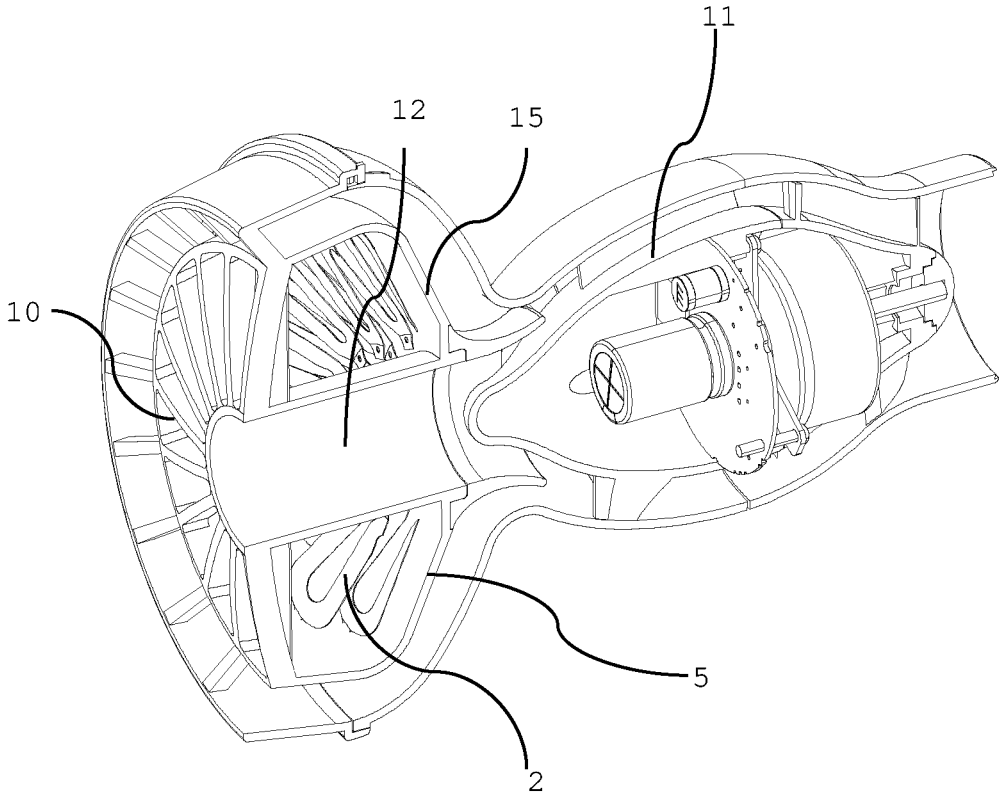
FIG. 7 represents another embodiment of the hairdryer according to the present disclosure, with a deflector separating the air stream into a central substream and a peripheral substream.
Figure 8:
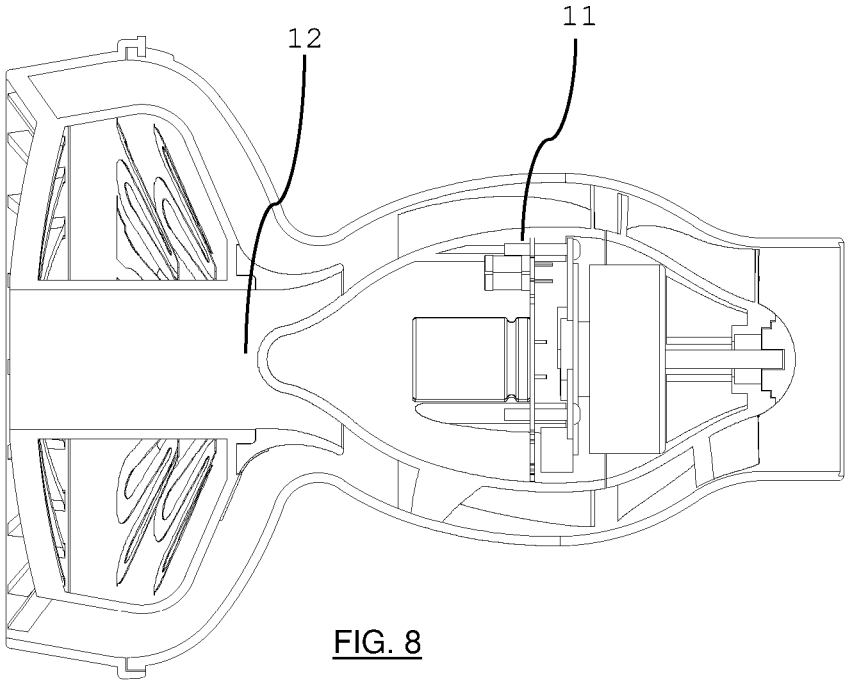
FIG. 8 is another view of the embodiment of FIG. 7.

In a second embodiment, the hairdryer additionally comprises an air stream separator 15 having a central channel 12 to separate the air stream into two substreams, a central substream and a peripheral substream. As illustrated by FIGS. 7 and 8, the central substream crosses the air stream separator 15 by the central channel 12 while the peripheral substream licks the walls of the deflector and the housing.

An outlet grid 10 is provided at the air outlet 9 to prevent the user to be in contact with the filter 6 which is at around 400° C. As a result, the grid must be made of a thin material as transparent as possible to prevent the transmission of the energy of the hairdryer and stay as cold as possible.

The hairdryer of the present disclosure has the advantage to dry hair efficiently and relatively quickly at low temperature, thanks to the combination of the selected wavelengths of infrared radiation and the low thermal inertia of the emitter. The hair temperature reaches 30-60° C. instead of 60-105° C. for a conventional hairdryer during drying. Furthermore, the heating time of the emitter is short, avoiding the user to wait before using the hairdryer at its optimum temperature and allowing a more precise temperature regulation.

The invention claimed is:

1. An infrared (IR) hairdryer (1) comprising:

a housing (7) with an air inlet (8) and an air outlet (9), the housing (7) including a motorized fan (4);

an infrared radiation source (2) for emitting IR radiant heat;

a back reflector positioned between the fan (4) and the infrared radiation source (2);

a filter (6) positioned at the outlet (9) of the hairdryer and configured to allow IR wavelengths comprised between 1.2 μm and 15 μm to leave said hairdryer and stopping IR wavelengths outside of 1.2 μm and 15 μm;

wherein the infrared source (2) has a thermal inertia allowing the infrared source (2) to reach a temperature up to 1000° C. in less than 10 seconds.

2. The infrared hairdryer according to claim 1, wherein the infrared radiation source (2) comprises a mesh or an etched foil.

3. The infrared hairdryer according to claim 2, wherein the etched foil has a thickness comprised between 30 and 150 μm.

4. The infrared hairdryer according to claim 2, wherein the mesh or the etched foil is arranged in a disc-shaped surface having a surface area greater than 30 $cm^2$.

5. The infrared hairdryer according to claim 2, wherein the etched foil is made of FeCrAl alloy.

6. The infrared hairdryer according to claim 2, wherein the etched foil is maintained in the hairdryer (1) by a holder (13) made of mica allowing an electrical insulation.

7. The infrared hairdryer according to claim 1, wherein the infrared radiation source has a power density comprised between 5 and 15 $W/m^3$.

8. The infrared hairdryer according to claim 1, wherein the filter (6) is a silicon window filter.

9. The infrared hairdryer according to claim 1, wherein the back reflector (5) is an anodized parabolic reflector made of aluminum.

10. The infrared hairdryer according to claim 1, wherein a side reflector (14) is provided to reflect peripheral radiation emitted by the infrared radiation source, said side reflector (14) being ring-shaped.

11. The infrared hairdryer according to claim 1, further comprising a deflector (11) to deviate a peripheral air stream along walls of the housing (7).

12. The infrared hairdryer according to claim 11, further comprising an air stream separator (15) having a central channel (12) to separate the air stream into two substreams, a central substream and a peripheral substream.

13. The infrared hairdryer according to claim 1, further comprising an outlet grid (10) at the air outlet (9) configured to prevent a user to be in contact with the filter (6).

14. The infrared hairdryer according to claim 1, wherein the motorized fan (4) is radial.

15. The infrared hairdryer according to claim 1, wherein the filter positioned at the outlet of the hairdryer is configured to allow IR wavelengths of 2 to 8 μm.

16. The infrared hairdryer according to claim 1, wherein the thermal inertia of the infrared source allows the infrared source to reach a temperature of up to 1000° C. in less than 5 seconds.

17. The infrared hairdryer according to claim 3, wherein the thickness of the etched foil is 50 to 120 μm.

18. The infrared hairdryer according to claim 4, wherein the surface area of the disc-shaped surface is greater than 40 $cm^2$.

19. The infrared hairdryer according to claim 7, wherein the power density of the infrared radiation source is 10 $W/m^3$.

20. An infrared (IR) hairdryer, comprising:

a housing having an air inlet and an air outlet;

a fan disposed in the housing and configured to cause an airflow to pass from the air inlet to the air outlet;

an infrared radiation source disposed in the housing and configured to emit IR radiant heat;

a back reflector between the fan and the infrared radiation source;

a filter disposed at the air outlet and configured to allow only IR wavelengths of 1.2 μm to 15 μm to leave the hairdryer;

wherein the infrared radiation source has a thermal inertia allowing the infrared source to reach a temperature of 1000° C. in less than 10 seconds.

* * * * *